US009991588B2

(12) United States Patent
Hansen et al.

(10) Patent No.: US 9,991,588 B2
(45) Date of Patent: Jun. 5, 2018

(54) HIGHLY CONDUCTIVE FIBER REINFORCED ANTENNAS

(71) Applicants: George C. Hansen, Heber City, UT (US); Nathan D. Hansen, Heber City, UT (US); Jon S. Bial, Woodland, WA (US); Gary Loomis, Woodland, WA (US)

(72) Inventors: George C. Hansen, Heber City, UT (US); Nathan D. Hansen, Heber City, UT (US); Jon S. Bial, Woodland, WA (US); Gary Loomis, Woodland, WA (US)

(73) Assignees: CONDUCTIVE COMPOSITES COMPANY, Heber City, UT (US); NORTH FORK COMPOSITES, LLC, Woodland, WA (US)

( * ) Notice: Subject to any disclaimer, the term of this patent is extended or adjusted under 35 U.S.C. 154(b) by 1005 days.

(21) Appl. No.: 14/035,844

(22) Filed: Sep. 24, 2013

(65) Prior Publication Data

US 2014/0091982 A1 Apr. 3, 2014

Related U.S. Application Data

(60) Provisional application No. 61/705,059, filed on Sep. 24, 2012.

(51) Int. Cl.
*H01Q 1/36* (2006.01)

(52) U.S. Cl.
CPC ..... *H01Q 1/36* (2013.01)

(58) Field of Classification Search
CPC ..... H01Q 1/36
(Continued)

(56) References Cited

U.S. PATENT DOCUMENTS 2,750,321 A * 6/1956 Koppelman ..... B29C 70/22 156/213
4,132,828 A * 1/1979 Nakamura ..... C04B 14/386 419/24

(Continued)

OTHER PUBLICATIONS

Chung (Chung, Deborah D.L., Carbon Fiber Composites, "Properties of carbon fibers," Butterworth-Heinemann, Boston, 1994, p. 65-78).*

(Continued)

*Primary Examiner* — James C Yager
*Assistant Examiner* — Kevin C Ortman, Jr.
(74) *Attorney, Agent, or Firm* — Christensen O'Connor Johnson Kindness PLLC

(57) ABSTRACT

A highly conductive fiber reinforced tubular antenna is composed of metal coated reinforcing fibers in a composite structure. The conductive fibers may be disposed in a tubular or cylindrical fashion unidirectionally parallel to or at an angle to the axis of the tube or cylinder, thus providing multifunctional properties of strength and conductivity. Alternatively, the conductive fibers may be non-woven in configuration and disposed on one or more wrapped layers to form the antenna. The fiber reinforced composites disclosed are both lighter and stronger than their metal counterparts, while the highly increased conductive surface area in the composite creates enhanced electrical or electromagnetic performance than tubular or cylindrical antennas made of metal or nonmetal composite structures.

20 Claims, 8 Drawing Sheets

(58) Field of Classification Search
USPC ..... 343/897, 791, 792; 428/35.7, 36.3, 36.8, 428/36.9, 36.91, 36.92
See application file for complete search history.

(56) References Cited

U.S. PATENT DOCUMENTS 5,554,997 A * 9/1996 Cobb ..... H01P 11/005 174/102 R
6,630,231 B2 * 10/2003 Perez ..... B32B 5/26 428/141
7,317,420 B2 * 1/2008 Aisenbrey ..... H01Q 9/40 343/700 MS

OTHER PUBLICATIONS

Dict (Dict, "Braid," Webster's Revised Unabridged Dictionary, 1913, C. & G. Merriam Co., Springfield, Mass. Under the direction of Noah Porter, D.D., LL.D., p. 1-3).*

* cited by examiner

HIGHLY CONDUCTIVE FIBER REINFORCED ANTENNAS

BACKGROUND OF THE INVENTION

1. The Field of the Invention

The present invention pertains to antennas, including radio frequency antennas of generally cylindrical construction, either as a linear or as a branched structure. More specifically, the present invention relates to antennas constructed from a composite structure of metal coated structural or reinforcing fibers or non-metal coated structural/reinforcing fiber composites with metal additives in the composite's polymer matrix.

2. The Relevant Technology

Historically, radio frequency antennas have been of several various constructions. In a first type of construction, antennas are composed of metal tubes. These antennas act as an efficient conductor of electrical energy. The disadvantage of such antennas, however, is that they are quite heavy, not very flexible, and are relatively easy to bend and, thus, break. A second type of antenna construction is comprised of structural fiberglass tubes with conductive wires extending downwardly through the tubes as the electromagnetic receptor. Relative to metal tubular antennas, fiberglass antennas are slightly more flexible and lighter in weight. A third type of antenna construction uses carbon/graphite fibers, which are somewhat conductive. However, carbon fiber composite systems alone are generally not sufficiently conductive to perform as well as an antenna. As such, additional materials must be added for the carbon fiber system to function satisfactorily as an antenna. In a fourth construction, an antenna is made from a combination of short fibers dispersed into a thermoplastic or thermoset polymer.

In recent years, a further antenna construction has been developed. This construction is composed of carbon fibers plated with nickel by either an electroplating process or electro-less process. However, antennas of this type of construction still require that other conductors, such as a silver film, be disposed over the nickel film for the antenna to perform in an acceptable electrically conductive manner. Accordingly, a need exists for materials, or a combination of materials, that can be used to construct a relatively light weight antenna with sufficient electric and electromagnetic properties.

BRIEF SUMMARY OF THE CURRENT INVENTION

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A radio frequency antenna includes a flexible elongated shaft composed of reinforcing fibers, either oriented unidirectionally along the length of the shaft or angularly to the shaft. Alternatively, the shaft may be composed of non-woven reinforcing fibers multi-directionally applied in a layer, with the layer being wrapped to form the shaft. The unidirectionally oriented reinforcing fibers and the non-woven reinforcing fibers are coated with a conductive metal, such as nickel, applied by chemical vapor deposition so that the conductive metal may comprise from about 25% to 85% by weight of the coated reinforcing fibers.

The radio antenna may be of hollow construction or may be of solid construction with a conductive or non-conductive core. Also, in cross-sectional shape the antenna may be circular, cylindrical, round, oval, elliptical, triangular, square, pentagonal, hexagonal, or octagonal.

The reinforcing fibers may be continuous or discontinuous. They may be composed of carbon, graphite, or fiberglass. They may also be composed of synthetic polymers such as aramid, nylon, rayon, or acrylic. The fibers may also be of natural composition, including of cellulose or silk. Further, the reinforcing fibers may be in a relatively wide diameter range, from about 2-20 μm.

Although nickel is a desired conductive metal for coating the reinforcing/structural fibers, other metals may also be used. Such additional metals may include, for example, aluminum, copper, and silver.

The radio frequency antenna may also include a scrim extending around the antenna to provide hoop strength for the antenna. The scrim may be composed of unidirectional reinforcing fibers extending around the antenna. The scrim alternatively may be composed of non-oriented reinforcing fibers arranged in a sheet for applying around the antenna. In addition, nanostrands of metal, such as nickel, may be added to the non-oriented reinforcing fiber scrim to increase the overall electrical conductivity of the scrim.

In a further aspect of the present invention, the scrim is composed of non-conductive material, such as reinforcing fibers, thereby to provide an electrical insulation between the layers of the conductive reinforcing fibers comprising the antenna. This results in layers of conductive reinforcing fibers being more efficient conductors.

In accordance with a further aspect of the present invention, the reinforcing fibers comprising the scrim itself may be coated with a conductive metal, for example, nickel.

As a further aspect of the present invention, a binding resin is utilized in conjunction with reinforcing fibers. The binding resin can be selected from a thermoset binding resin or a thermoplastic binding resin. In addition, nanostrands of conductive metal may be added to the binding resin to increase the overall electrical conductivity of the antenna.

BRIEF DESCRIPTION OF THE DRAWINGS

In order that the manner in which the above-recited and other features and advantages of the invention are obtained will be readily understood, a more particular description of the invention will be rendered by reference to specific embodiments thereof which are illustrated in the appended drawings. Understanding that these drawings only depict typical embodiments of the invention and are not therefore considered to be limiting of its scope, the invention will be described and explained with additional specificity and detail through the use of the accompanying drawings in which.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present invention pertains to the use of a new class of more advanced metal (e.g., nickel)-coated structural or reinforcing fibers (e.g., carbon/graphite) and scrims to form tubular antenna structures. This composite material performs both as a structural member of the antenna and as an efficient electrical or electromagnetic conductor. Such composite antennas can be of an elongated tubular construction. The tubes may be of singular construction, may be constructed in multiple insertable lengths, or constructed with telescoping sections. The antenna can be constructed to have directional characteristics thereby composed of multiple tubes of well known geometries and sizes. For the purposes of this patent application, "tubular" or "cylindrical" may mean a hollow or solid longitudinal member of any geometrical cross section, including round, oval, elliptical, triangular, square, pentagonal, hexagonal, octagonal and so forth.

The metal (e.g., nickel) coated fibers and scrims of the present disclosure are superior for several reasons. First, the fibers are coated through a chemical vapor deposition method, thus allowing for more uniform, conformal, and ductile coating. This ductile coating leads to mechanical advantages over other prior metal coating and plating processes.

Figure 1:
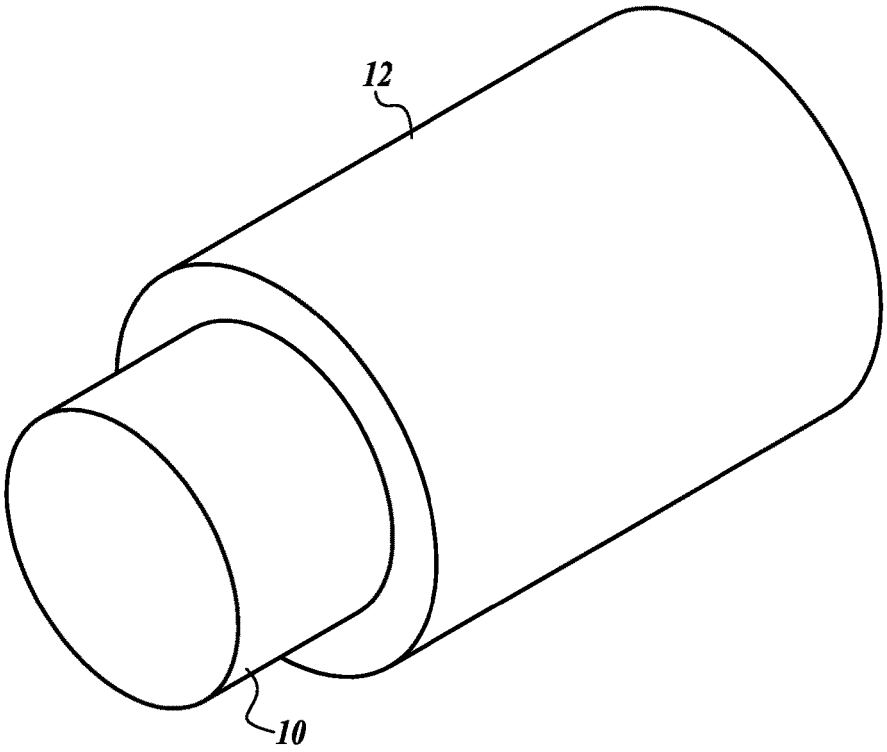
FIG. 1 is a schematic isometric view of a length of carbon/graphite fiber with a thin layer of metal (nickel) coating applied through a chemical vapor deposition process.

Second, the chemical vapor deposition process allows for a wide range of coating levels uniformly applied to the structural fibers; thus the conductivity can be specifically engineered within a large range. For instance, whereas metal (nickel)-coated carbon fiber is traditionally available in the range of approximately 40% nickel, chemical vapor deposition enables fibers to be coated from 25% to 85% metal (nickel) by weight. As schematically illustrated in FIG. 1, the illustrated carbon/graphite fiber 10 is approximately 3 to 7 microns in diameter. The metal (nickel) coating 12 may be from 50 nanometers to 5 microns in diameter, depending on the weight percentage of metal (nickel) desired for the composite structure. This ability to add more or less metal (nickel) to the fiber 10 then increases or decreases the overall conductivity of the fiber. The relationship between the increase in composition and the increase in conductivity is not linear. For instance, if enough metal (nickel) is added to the fiber such that its weight is doubled, the electrical conductivity of the fiber will increase by an order of magnitude. As a consequence, it is possible to achieve the desired level of conductivity required for the desired performance level of the antenna structure.

Third, the metal (nickel)-coated fibers can be of different types of structural/reinforcing fibers, including metal (nickel)-coated carbon/graphite fibers, metal (nickel)-coated polymer fibers, such as PBO, aramid, rayon or nylon fibers, or natural fibers such as cellulose or silk. The fibers may also be in the form of a fabric or a braid, which may be woven from metal (e.g., nickel)-coated fibers. In addition, braided fibers may still be equally metal-coated after weaving or braiding. The conductive fibers may also come in sheet form as metal-coated non-woven carbon/graphite or cellulose paper sheets.

Figure 2A:
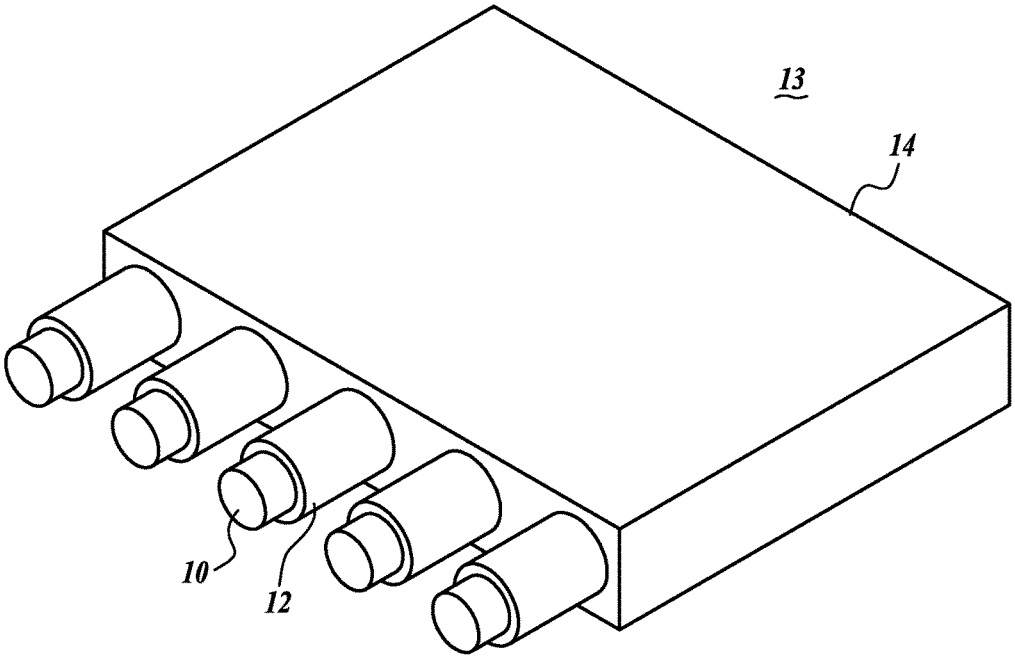
FIG. 2A is a schematic isometric cross-sectional view of a pre-impregnated composite structure comprised of unidirectional metal-coated structural fibers within a polymer resin matrix.
Figure 2B:
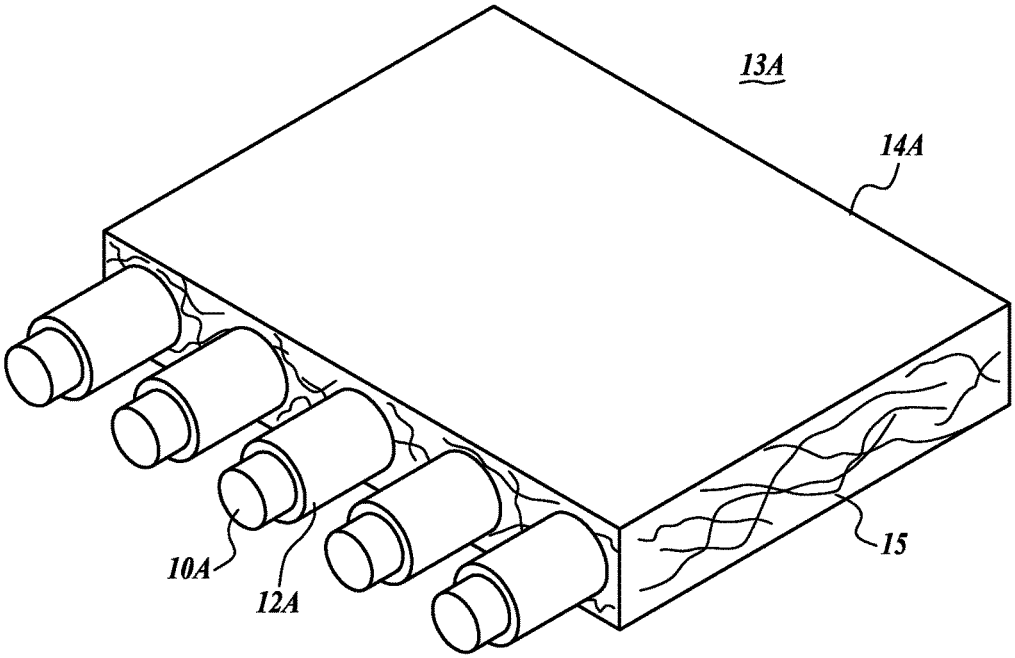
FIG. 2B is a schematic isometric view of a pre-impregnated composite structure comprised of unidirectional metal (nickel)-coated carbon/graphite fibers and a polymer resin matrix with metal (nickel) nanostrands added to the matrix for increased electrical conductivity.

As illustrated by FIG. 2B, the conductivity of the composite structure 13A may also be provided for or enhanced by the addition of metal (nickel) nanostrands 15, a highly bifurcated nanostructure metal (nickel) powder, to the polymer resin matrix of the composite structure. Nanostrands can be added to the resin matrix prior to the unidirectional structural fiber being pre-impregnated with the resin.

Nanostrands are sub-micron particulates of metal comprised of a high-aspect ratio branching three dimensional network. The metallic nanostrands may have an average diameter under about four microns and an average aspect ratio (length-to-diameter ratio) of about ten-to-one or greater. The metallic nanostrands may be constructed of a metal such as nickel or iron. The nanostrands may also provide additional mechanical strength and/or thermal conductivity.

The metallic nanostrands may have a random orientation so that the electrical conductivity of the composite material is substantially the same in all directions. The metallic nanostrands cross each other to provide many current pathways. If desired, nanostrands with a comparatively high degree of branching may be used to enhance the electrical conductivity of the composite material.

Metallic nanostrands are disclosed in U.S. Pat. Nos. 7,935,415, 7,947,773, and 8,361,608, hereby incorporated by reference into the present application.

The metal (nickel)-coated unidirectional fibers, metal (nickel)-coated non-woven sheets, and metal coated (nickel) nanostrands can be used individually or in combination with each other to affect the strength and conductivity of the antenna. Moreover, the conductivity can be controlled lengthwise down the antenna (along the axis or length of the fibers), circumferentially around the antenna (from fiber to fiber), in both directions, or radially through the wall of the antenna.

Each material, once selected, is pre-impregnated with a polymer resin matrix. FIG. 2A illustrates schematically unidirectional metal-coated structural fibers 10 within a pre-impregnated polymer resin matrix 14, shown schematically as a rectangular envelope surrounding the metal coated fibers 10.

Figure 3:
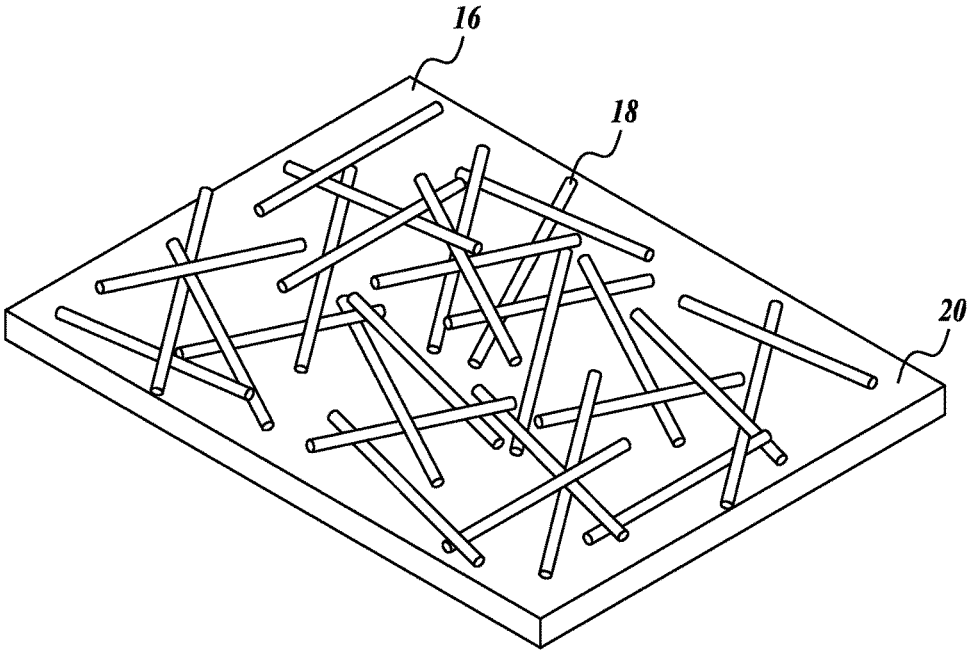
FIG. 3 is a perspective schematic view of a metal-coated nonwoven structural fiber sheet impregnated with a polymer resin matrix.

As shown by FIG. 3, nonwoven metal (nickel)-coated structural sheets (e.g., carbon/graphite) sheets 16 composed of chopped strands of structural fibers 18 coated with a metal (nickel), may also be pre-impregnated with a polymer resin matrix 20 (schematically shown). The fibers 18 comprising the non-woven sheets 16 may either be coated with metal (nickel) prior to being chopped and laid up into sheets 16 or may be coated after the fibers 18 have been assembled into sheets 16.

As tubular structures typically require a scrim to add hoop strength, one option is to use a metal (nickel)-coated fiber scrim as a multifunctional interlaminar conductor. A scrim may consist of a layer of unidirectional or otherwise arranged structural/reinforcing fibers that are wrapped around the circumference of the tubular structure. Similar to the metal (nickel) coated fiber, the metal (nickel) chemical vapor deposition coating level and resulting conductivity of the scrim can be designed over a range of three orders of magnitude or surface resistivity.

Figure 4:
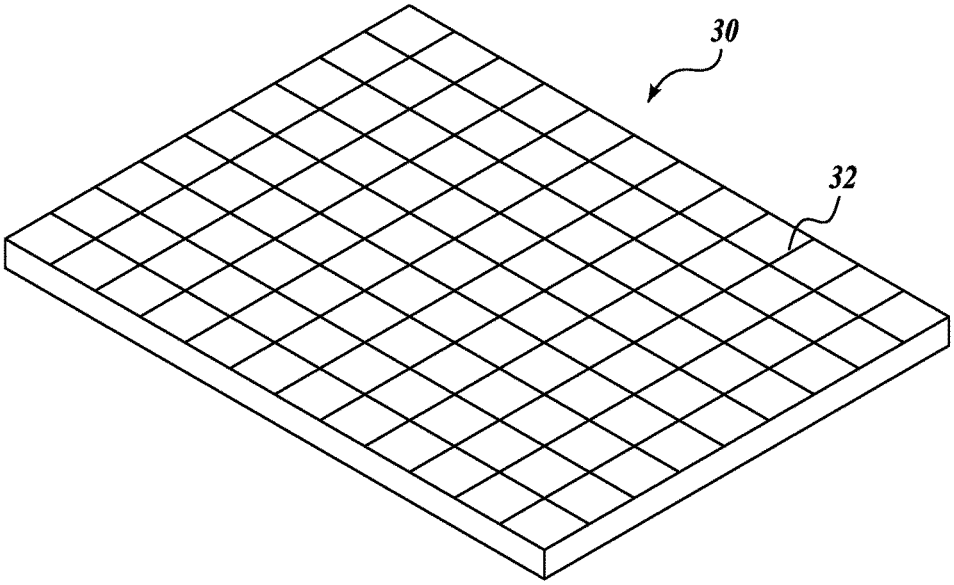
FIG. 4 is a perspective view of a sheet of insulating glass impregnated with a polymer resin matrix.

Normally, a scrim is made of insulating glass 32 arranged in a criss-cross matrix, such as scrim 30, as schematically illustrated in FIG. 4. However, if a metal (nickel)-coated scrim is used for mechanical purposes, then an additional level of multifunctionality is achieved by permitting conductivity axially, radially, and circumferentially throughout the composite. Furthermore, the use of a glass scrim typically causes the inside of the tube to be nonconductive. But if a conductive metal (nickel)-coated scrim is used, conductivity may be achieved throughout the entire wall structure. This property enhances the conductivity of the tube and it makes it so that tubular sections may be inserted or stacked end-to-end with little loss in electrical continuity, much like a collapsible antenna.

The typical volume resistivity of the antenna can be designed from being approximately fully dielectric (about 10*e* 10 ohm-cm) to having a resistivity approaching that of highly conductive metal (about 10*e* −4 to 10*e* −5 ohm-cm). The desired level of electric or electromagnetic conductivity can be designed into the antenna by the relative amount of metal (nickel) utilized in the unidirectional structural (carbon/graphite) fibers, non-woven structural (carbon/graphite) fiber sheets, or metal (nickel) nanostrands.

The ability to vary the conductivity of the composite antenna by choosing the appropriate level of metal (nickel) on the needed fibers and/or scrim is an advantage provided by the present invention. It is a vast improvement over the historical use of 40% nickel-coated carbon fiber used alone. Whereas the prior methods of forming antennas from nickel-coated fiber methods still required the addition of metallic treatment in order for the antenna to operate satisfactorily, the suite of materials disclosed above can be used alone or in conjunction with each other to create antennas engineered based upon desired mechanical and electrical properties.

The structural (carbon/graphite fiber) antenna 40 can be constructed by wrapping the metal (nickel)-coated structural (carbon/graphite) fiber matrix 42 or metal (nickel)-coated non-woven structural (carbon/graphite) sheets on a mandrel 47. In this regard, see FIG. 6, the unidirectional structural or reinforcing (carbon/graphite) fibers or non-woven structural fibers (carbon/graphite) arranged in sheets are previously coated with a desired relative amount of metal (nickel) and also include an appropriate resin. In addition, a scrim 44 may be utilized consisting of structural (carbon/graphite) fibers extending transversely to the longitudinal metal (nickel)-coated structural (carbon fibers) or to the fibers of the metal (nickel)-coated non-woven sheets of structural fibers. The scrim gives the antenna hoop strength to resist the breaking of the antenna as it is bent under load. In this situation, the scrim helps maintain the circular shape of the antenna under bending load. The conductive scrim also provides for conductivity transversely throughout the composite.

Figure 5A:
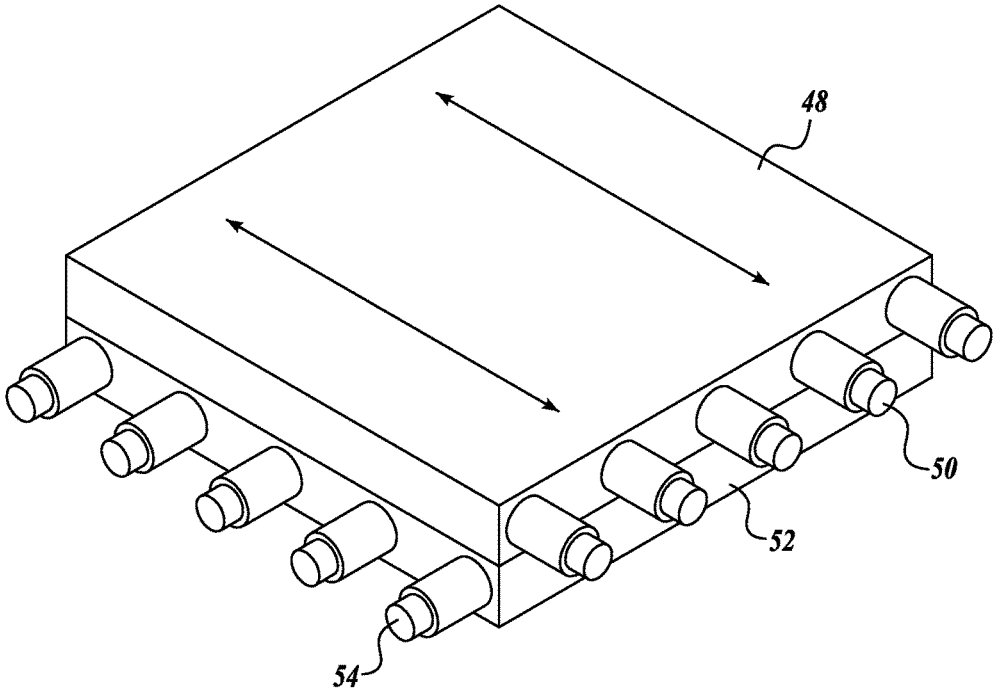
FIG. 5A is a perspective schematic view of a composite structure comprised of one layer of pre-impregnated unidirectional metal-coated structural/reinforcing fibers with another layer of pre-impregnated unidirectional metal-coated structural/reinforcing fibers running perpendicular to the first layer.
Figure 5B:
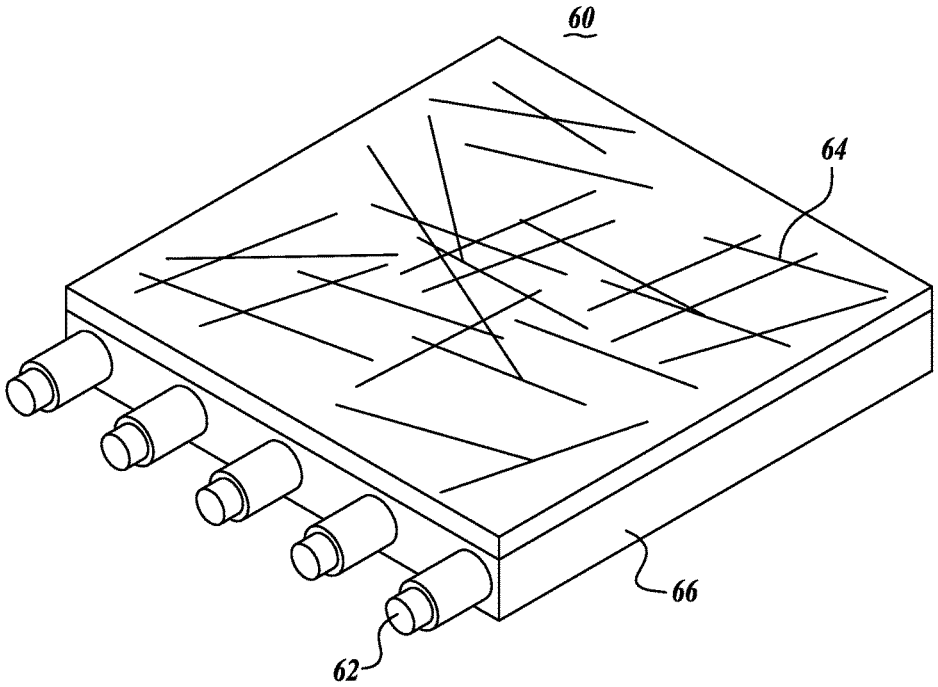
FIG. 5B is a perspective schematic view of a composite structure comprised of one layer of pre-impregnated unidirectional metal-coated structural fiber with another layer of pre-impregnated non-woven metal-coated structural fiber paper.
Figure 5C:
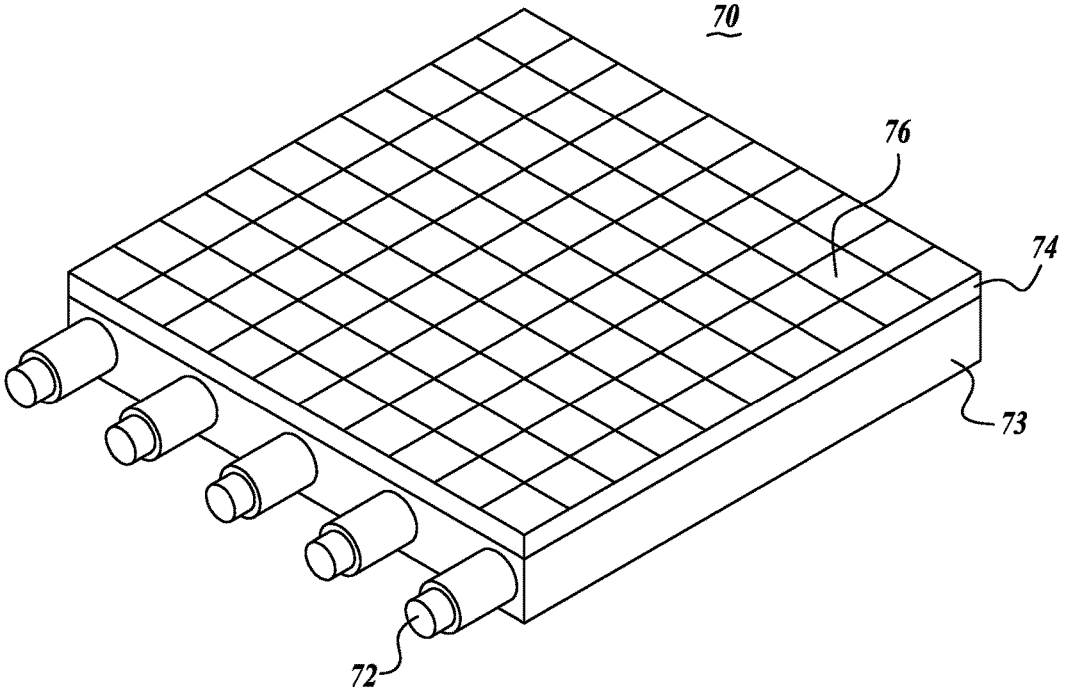
FIG. 5C is a perspective schematic view of a composite structure comprised of one layer of pre-impregnated unidirectional metal-coated structural fibers with another layer of pre-impregnated insulated glass scrim.

FIGS. 5A-C illustrate some possible variations of the antenna lay-up structure. The composite structure of FIG. 5A is comprised of layers 48 of unidirectional metal (nickel)-coated structural (carbon/graphite) fibers 50. Such fibers run longitudinally to the antenna structure for the primary structure of the composite. A scrim 52 layer comprised of unidirectional metal (nickel)-coated structural (carbon/graphite) fibers 54 is then placed perpendicular to the longitudinal unidirectional composite layers 48. Scrim layer 52 provides both increased conductivity and hoop strength to the composite structure.

The composite structure 60 of 5B is comprised of unilateral metal (nickel)-coated structural (carbon/graphite) fibers 62 in combination with metal (nickel)-coated non-woven sheets 64. Layers 66 of unidirectional metal (nickel)-coated structural/reinforcing (carbon/graphite) fibers run longitudinally to the antenna structure for the primary structure of the composite. A scrim layer 64 comprised of metal (nickel)-coated non-woven sheets is then laid on top of the unidirectional fiber structure. This layer provides increased conductivity with hoop strength for the composite structure.

The composite structure 70 of 5C is comprised of unidirectional metal (nickel)-coated structural (carbon/graphite) fibers 72 in a layer 73. Such fibers run longitudinally to the antenna structure for the primary structure of the composite. A scrim layer 74 comprised of insulated glass 76 is then laid on top of the unidirectional fiber structure. As previously mentioned, this more traditional glass scrim may be coated with nickel for increased conductivity.

Figure 6A:
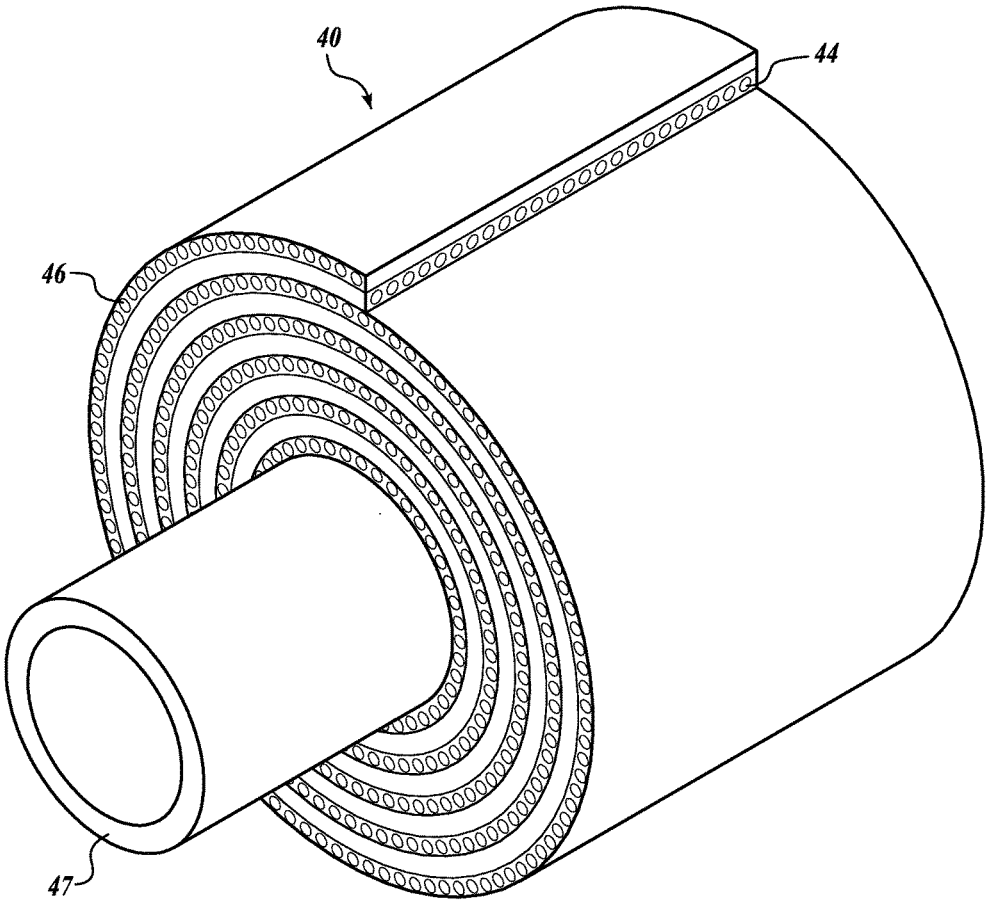
FIG. 6A is a perspective schematic view of a metal-coated composite material in accordance with the present disclosure shown wrapped around a mandrel for baking purposes.

As shown in FIG. 6A, a combined unidirectional metal (nickel)-coated structural (carbon/graphite) fibers 46 or metal (nickel)-coated non-woven structural fiber (carbon/graphite) sheets with the corresponding scrim 44 of unidirectional metal (nickel)-coated structural fibers extending transversely to fibers 46, and resin are tightly wrapped over a mandrel 47. Cellophane tape (not shown) is then tightly wrapped over the metal (nickel)-coated structural (carbon/graphite) fibers or metal (nickel)-coated woven structural (carbon/graphite) sheets. Thereafter, the wrapped mandrel 47 is baked at an appropriate temperature for an appropriate length of time so as to activate the resin that binds the metal (nickel)-coated carbon/graphite fibers or metal (nickel)- coated non-woven sheets and scrim together in a tubular structure. During the baking process, the resin liquefies and penetrates through the graphite fibers and scrim.

After baking, the mandrel is removed from the oven and cooled. Upon cooling, the formed tubular antenna 40 is removed from the mandrel 47, after which the cellophane wrapping 48 is removed. Thereafter, the resulting tubular-shaped antenna may be sanded to remove any ridges caused by the cellophane. After sanding, an optional colored or clear finish coat may be sprayed onto or otherwise applied to the antenna. Such coating should not be applied to areas where continued surface resistivity is desired. Once the antenna has been sufficiently sanded or the desired coating is applied, a connector (not shown) is fitted to the proximal end of the antenna 40. The connector can be applied using a nanostrand bearing adhesive in order to achieve sufficient electrical continuity.

Figure 6B:
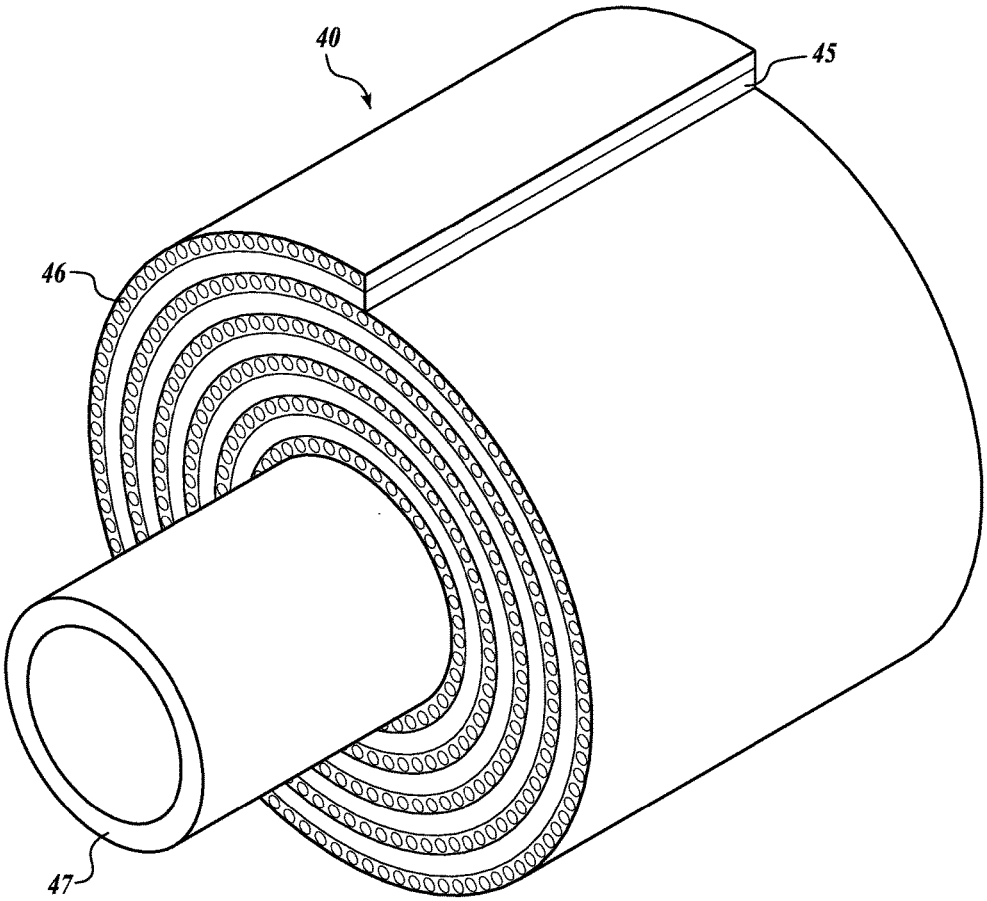
FIG. 6B is a perspective schematic view of a further metal-coated composite material in accordance with the present disclosure shown wrapped around a mandrel for baking.

FIG. 6B illustrates a layup of an antenna construction similar to that shown in FIG. 6A. In this regard, as shown in FIG. 6B, metal (nickel)-coated carbon/graphite pattern(s) 40 is tightly wrapped over a mandrel 47. However, in place of the scrim layer 44 shown in FIG. 6A composed of unidirectional, metal-coated carbon/graphite fibers (extending transversely to the fibers of pattern 70), in FIG. 6B, the second or scrim layer 45 may be a layer of pre-impregnated non-woven metal (nickel)-coated sheet material similar to that shown in FIG. 3 above. Alternatively, the second or scrim layer 45 in FIG. 6B may be composed of a pre-impregnated insulated glass scrim similar to that shown in FIG. 4 above. In other words, the second or scrim layer 45 can be composed of the composite structures shown in FIG. 5B above or shown in 5C, respectively, above.

Another solution to obtaining desired mechanical and electrical characteristics of the antenna is through the primary use of metal (nickel)-coated materials in combination with unidirectional fibers or non-woven sheets without metal (nickel) coating. Such antennas would then have the addition of a metal (nickel)-coated scrim. This alone may result in sufficient conductivity at the interior and exterior surfaces of the antenna. In this regard, the scrim can be in the form of an overwrap or spiral wrap over or within the non-coated structural (carbon/graphite) fibers or non-woven structural (carbon/graphite) sheets. This may be applied while the non-coated structural fibers or non-woven structural sheets are being rolled onto a mandrel or after. The use of a conductive scrim results in a low-cost method of construction for an antenna relative to if the entire antenna were comprised of metal (nickel)-coated structural (carbon/graphite) fibers or non-woven structural sheets.

If increased conductivity in the antenna is desired transversely to the longitudinally disposed structural (carbon) fibers, metal (nickel) nanostrands may be utilized, as shown in FIG. 2B, thereby causing the composite to be more conductive in the transverse direction of the antenna. Metal (nickel) nanostrands may be utilized in antennas made of metal (nickel)-coated structural (carbon/graphite) fiber, non-woven (carbon/graphite) structural fiber sheets, and of non-coated unidirectional structural (carbon/graphite) fibers.

Figure 7:
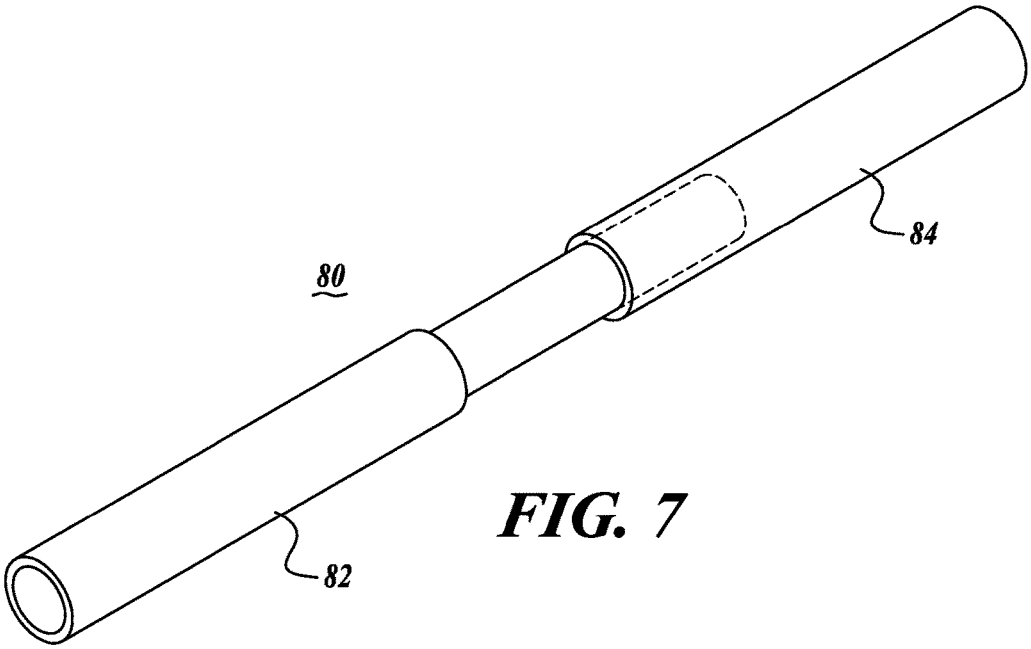
FIG. 7 is a perspective schematic view of the antenna structure illustrating the conductive seams that may join separate antenna sections.

An antenna 80 according to the above described constructions results in a lightweight structure which may include a plurality of antenna sections 82, 84 that can be assembled for use, similar to the manner in which a fishing rod is assembled from a plurality of rod segments. The resulting composite antenna could not only be collapsed or disassembled into a compact configuration when not in use, but is also lightweight, relatively stiff, and exhibit significant strength while in use thereby performing both mechanically and electrically in substantially the manner of a metallic antenna. As illustrated by FIG. 7, due to the increased conductivity of the entire structure, conductivity at the seams of adjoining segments will be comparable to that of the total antenna structure.

A further embodiment of the present disclosure is the ability to increase and control the available electromagnetic surface area as a function of skin depth and frequency. For instance, a one millimeter diameter metal tube that is one meter long has an available conductive surface area of 31.4 cm sq. An antenna made from a conductive composite tube of this size will have approximately 24,000 individually coated fibers, each 7 microns in diameter, thus giving the composite structure a metal surface area of 5275 cm sq. This increased surface area facilitates higher conductivity throughout the composite structure.

The following are examples that illustrate a small sample of what may be achieved when varying the conductive materials are added to the antenna composite structure.

EXAMPLES

1. A tubular monopole 40 MHz antenna was constructed of nickel-coated carbon/graphite fibers with a lighter nickel coating (25% nickel by weight). The antenna was a tapered composite, ⅜" diameter at the base and ¼" diameter at the tip, and is one meter long, with a glass scrim to provide mechanical support. When compared to an antenna made of aluminum, the composite antenna had an improved voltage standing wave radio (VSWR), broader bandwidth response, and was lighter and stronger.

2. A conductive composite antenna is made with 40% nickel coating and a conductive carbon/graphite fiber scrim. This antenna had an increased electrical performance over the composite antenna described in example #1.

3. A directional yagi antenna was constructed by replacing the directors and reflectors with conductive composites, along with a composite boom section. This antenna exhibited equal performance to its metal counterpart, but the elements/boom assembly weighed only 16% as much as the weight of the metal assembly.

4. A monopole of conductive composite was field tested compared to an aluminum antenna of similar geometry. The conductive composite antenna exhibited send and receive gain equal to the aluminum antenna at about 3 percent of the weight, and about three times stiffer.

The foregoing are descriptions of preferred embodiments which are given here by way of example only. The present invention is not to be taken as limited to any of the specific features as described, but comprehends all such variations thereof come within the scope of the appended claims.

While the preferred embodiment of the invention has been illustrated and described, it will be appreciated that various changes can be made therein without departing from the spirit and scope of the invention.

We claim:

1. A tubular conductive composite structure, having an interior surface and an exterior surface, comprising:

a. a plurality of materials layers comprising longitudinally parallel, electrically conductive reinforcing fibers extending along the length of the composite structure and embedded in a curable or otherwise flowable resin; and b. at least one spiral-wrapped, interlaminar scrim sheet of randomly oriented, electrically conductive high strength fibers interlaid between and spirally-wrapped with the material layers of longitudinally parallel, electrically conductive reinforcing fibers, the at least one spiral-wrapped, interlaminar scrim sheet exhibiting high strength in the circumferential direction of the composite structure as well as providing electrically conductive paths in the transverse, radial, and longitudinal directions;

c. wherein the interior and exterior surfaces of the tubular structure are electrically conductive and comprise the material layers of longitudinally parallel, electrically conductive reinforcing fiber.

2. The composite structure according to claim 1, wherein the at least one spiral-wrapped, interlaminar scrim sheet further comprises nanostrands of metal added to a polymer matrix to increase the overall electrical conductivity of the spiral-wrapped ,interlaminar scrim sheet.

3. The composite structure according to claim 1, wherein the at least one spiral-wrapped, interlaminar scrim sheet comprises reinforcing fibers coated with a conductive metal.

4. The composite structure according to claim 1 being of hollow construction.

5. The composite structure according to claim 1 comprising solid construction with either a conductive or non-conductive core.

6. The composite structure according to claim 1, wherein the cross-sectional shape of the composite structure is selected from the group consisting of circular, cylindrical, round, oval, elliptical, triangular, square, pentagonal, hexagonal, and octagonal.

7. The composite structure according to claim 1, wherein the reinforcing fibers of the plurality of material layers are continuous.

8. The composite structure according to claim 1, wherein the reinforcing fibers of the plurality of material layers are discontinuous.

9. The composite structure according to claim 1, wherein the reinforcing fibers of the plurality of material layers comprise material selected from the group consisting of carbon, synthetic polymers, aramid nylon, rayon, acrylic, cellulose, silk, and fiberglass.

10. The composite structure according to claim 1, wherein said reinforcing fibers of the plurality of material layers are of a diameter within the range of from 2-20 μm.

11. The composite structure according to claim 1, wherein conductive metal is applied to the reinforcing fibers of the plurality of material layers, and said conductive metal is selected from the group consisting of nickel, aluminum, copper, and silver.

12. The composite structure according to claim 1, wherein the electrically conductive reinforcing fibers of the plurality of material layers are arranged in a weave or a braid.

13. The composite structure according to claim 12, wherein the electrically conductive reinforcing fibers are coated with a conductive metal, either before weaving or braiding, or after weaving or braiding.

14. The composite structure according to claim 1, wherein the resin utilized in conjunction with the reinforcing fibers of the plurality of material layers is selected from the group consisting of a thermoset binding resin and a thermoplastic binding resin.

15. The composite structure according to claim 14, wherein the plurality of material layers further comprises nanostrands of a conductive metal, said nanostrands added to the resin, said nanostrands increasing the overall electrical conductivity of the structure.

16. A radio frequency antenna, having an interior surface and an exterior surface, comprising:

a. a plurality of materials layers comprising longitudinally parallel, electrically conductive reinforcing fibers extending along the length of the antenna and embedded in a curable or otherwise flowable resin; and b. at least one spiral-wrapped, interlaminar scrim sheet of randomly oriented, electrically conductive high strength fibers interlaid between and spirally-wrapped with the material layers of longitudinally parallel, electrically conductive reinforcing fibers, the at least one spiral-wrapped, interlaminar scrim sheet exhibiting high strength in the circumferential direction of the antenna as well as providing electrically conductive paths in the transverse, radial, and longitudinal directions;

c. wherein the interior and exterior surfaces of the antenna are electrically conductive and comprise the material layers of longitudinally parallel, electrically conductive reinforcing fibers.

17. The antenna according to claim 16, wherein the reinforcing fibers of the plurality of material layers are continuous.

18. The antenna according to claim 16, wherein the at least one spiral-wrapped, interlaminar scrim sheet further comprises nanostrands of metal added to a polymer matrix to increase the overall electrical conductivity of the at least one spiral-wrapped, interlaminar scrim sheet.

19. The antenna according to claim 16, wherein the at least one spiral-wrapped, interlaminar scrim sheet comprises reinforcing fibers coated with a conductive metal.

20. The antenna according to claim 16, wherein the at least one plurality of material layers further comprises nanostrands of a conductive metal, said nanostrands added to the resin, said nanostrands increasing the overall electrical conductivity of the antenna.

* * * * *